US005086318A

United States Patent [19]

Takeda et al.

[11] Patent Number: 5,086,318

[45] Date of Patent: Feb. 4, 1992

[54] IMAGE FORMING APPARATUS HAVING TRANSFER MATERIAL CARRYING DEVICE

[75] Inventors: Atsushi Takeda, Kawasaki; Takashi Hasegawa, Matsudo, both of Japan

[73] Assignee: Cannon Kabushiki Kaisha, Tokyo, Japan

[21] Appl. No.: 714,989

[22] Filed: Jun. 14, 1991

Related U.S. Application Data

[63] Continuation of Ser. No. 622,143, Dec. 4, 1990, abandoned, which is a continuation of Ser. No. 333,044, Apr. 4, 1989, abandoned.

[30] Foreign Application Priority Data

Apr. 5, 1988 [JP] Japan ..... 63-83381

[51] Int. Cl.[5] ..... G03G 15/14; G03G 21/00

[52] U.S. Cl. ..... 355/271; 271/308; 271/900; 271/312; 355/326; 355/311; 355/315; 346/153.1

[58] Field of Search ..... 355/271, 272, 274, 315, 355/326, 327, 311, 75; 271/307, 308, 311, 312, 900; 101/DIG. 37; 346/153.1, 160

[56] References Cited

U.S. PATENT DOCUMENTS 3,832,053 8/1974 Goel et al. ..... 355/274 X
4,371,251 2/1983 Morse ..... 355/274
4,712,906 12/1987 Bothner et al. .
4,873,541 10/1989 Hirose et al. ..... 346/160.1

FOREIGN PATENT DOCUMENTS 2930568 2/1980 Fed. Rep. of Germany .
3704583A1 8/1987 Fed. Rep. of Germany .
57-99674 6/1982 Japan ..... 355/271
61-99170 5/1986 Japan ..... 355/271
545496 1/1974 Switzerland .

*Primary Examiner*—R. L. Moses
*Attorney, Agent, or Firm*—Fitzpatrick, Cella, Harper & Scinto

[57] ABSTRACT

An image forming apparatus wherein an image formed on an image bearing member is transferred onto a transfer material carried on the transfer material carrying member. The transfer material carrying member is capable of electrostatically attracting a plurality of transfer materials, so that good quality images can be provided at a high overall image formation speed with a simple structure, because the possible deterioration of the quality of the image attributable to the difference between the effect of presence of the transfer material on the transfer material carrying member and the absence thereof on the transfer material carrying member can be minimized.

74 Claims, 7 Drawing Sheets

IMAGE FORMING APPARATUS HAVING TRANSFER MATERIAL CARRYING DEVICE

This application is a continuation of U.S. Pat. application Ser. No. 622,143 filed Dec. 4, 1990, which is a continuation of U.S. Pat. application Ser. No. 333,044 fixed Apr. 4, 1989, both abandoned.

FIELD OF THE INVENTION AND RELATED ART

The present invention relates to an image forming apparatus provided with an image transfer device for transferring an image formed on an image bearing member onto a transfer material carried on transfer material carrying means, and more particularly to a color image forming apparatus for forming a color image by transferring a plurality of toner images formed on the image bearing member onto one and the same transfer material.

Various proposals have been made as to processes such as an electrophotographic process, particularly an electrophotographic color copying process for providing a color image by superimposingly transferring plural color images onto the same transfer material. One of such methods used generally is disclosed in Japanese Laid-Open Patent Application No. 18653/1980.

Referring first to FIG. 10, this process will be described.

Around an image bearing member such as a cylindrical electrophotographic photosensitive member 1, a charger 2 and an exposure device 3 are provided to form an electrostatic latent image on the image bearing member by an ordinary electrophotographic process. The latent image is developed by a developing device 4 including a plurality of developing units 4Y, 4M, 4C and 4B containing different color developers so that a visualized toner image is formed on the image bearing member.

On the other hand, a transfer material P such as a transfer sheet of paper is supplied to an image transfer device 4 by feeding means 6 from the cassette 5. The transfer device 10, as shown in FIG. 11, usually comprises a transfer material supporting member 11 in the form of a cylinder or a drum, a transfer material gripper 12 provided on the transfer material supporting member 11 to grip a leading edge of the transfer material P supplied to the transfer material supporting member 11, and a transfer material supporting sheet (dielectric material sheet) in the form of film having a high resistance to carry the transfer material P, the transfer material carrying sheet covering an opening 13 (shown by broken lines) formed in the circumference of the transfer material supporting member 11.

With this structure, the transfer material P supported on the transfer material supporting member 11 is gripped at its leading edge by a gripping pawl (gripper) for gripping the transfer material and movable substantially vertically which constitutes the transfer sheet gripping means 12. The portion of the transfer material P other than the leading edge is carried on the transfer material supporting sheet 14. The transfer material P which has been gripped by the gripper 12 and carried on the transfer material carrying sheet 14 is contacted to the image bearing member 1 with the rotation of the transfer material supporting member 11. With the rotation, electric charge having a polarity opposite to that of the toner is applied to the backside of the transfer material carrying sheet by a corona discharger 15 disposed inside the transfer material carrying member 11, or a voltage having a polarity opposite to that of the toner is applied thereto by an electrically conductive roller or the like, whereby the toner image is transferred onto the transfer material P from the image bearing member 1.

In the same manner, 3–4 images are transferred onto the same transfer material P, and then the transfer material P is subjected to an AC electric discharge operation by corona dischargers (charge removers) 16 disposed at both sides of the transfer sheet to weaken the attraction of the transfer material to the transfer material carrying sheet 14. Then, the leading edge of the transfer material P is raised by a transfer material raising member (not shown) to separate the transfer material from the transfer material carrying sheet 14 provided on a part of the transfer material supporting member 11, as shown in Japanese Patent Application Publication 27097/1985, for example, and a separation pawl 17 is inserted between the transfer material and the transfer material supporting sheet. The transfer material P is separated by the cooperation of the discharger 16 and the separating pawl 17 from the transfer material carrying member 11 in this manner and is conveyed to an image fixing device 18 where the image is fixed thereon, and the transfer sheet P is discharged onto a tray 19.

The image bearing member 1 is cleaned by a cleaning device 20 so that the toner remaining on its surface is removed to be prepared for the next color image forming operation.

The conventional transfer device in the image forming apparatus is advantageous in good registration among different color images, because the transfer sheet P is gripped by the gripper 12, and because the transfer material P is supported on the transfer material supporting member 11 while it receives the different color images. On the contrary, however, it involves the disadvantages that the structure of the gripper is complicated, that no image can be formed at the edge portion of the transfer material where it is gripped by the gripper, that only one transfer material can be carried on the periphery of the transfer device 10 in the form of a drum because of the necessity of the transfer material P being gripped by the gripper 12, and therefore, that the copying speed when plural copies have to be produced is low.

U.S. Pat. No. 4,712,906 discloses that a surface of a transfer material is formed of a thin film of an elastomer, and a plurality of sucking chambers are disposed and arranged circumferentially in the transfer drum adjacent to the surface of the drum. The thin film of the elastomer is provided with sucking apertures communicating with the sucking chambers. The transfer material is attracted to the surface of the transfer drum through the sucking apertures so as to retain and carry the transfer material thereon.

With this means, it is not necessary for the transfer material to be gripped by the gripper. In addition, if plural sucking apertures are formed spaced in the circumferential direction of the transfer drum, plural transfer materials can be simultaneously retained and carried on the surface of the transfer drum. However, there still are disadvantages that the retaining positions of the transfer material can not be changed, that the structure of the transfer drum is complicated, with the result of a bulky and high cost device. In addition, the surface layer of the elastomer deforms toward the inside of the transfer drum by operation of the sucking device, and therefore, a non-transferred portion can appear in the reproduced image.

Japanese Laid-Open Pat. Application No. 32079/1980 discloses a transfer drum provided with a surface dielectric layer. In the transfer drum, a corona charger for attracting the transfer sheet (transfer material) is used, and a conductive roller or another charger having a polarity opposite to that of the corona charger for attracting the transfer sheet is disposed facing the corona charger. The transfer material is retained on the dielectric material sheet on the transfer drum surface by electrostatic attraction force and is carried thereon.

This transfer drum is advantageous in that it does not require a gripper or sucking device and can retain and carry the transfer sheet on the transfer drum with high efficiency.

However, the investigation by the present inventors has revealed problems. In an image forming apparatus capable of using plural sizes of the transfer sheet, the transfer drum naturally has a circumferential length larger than the maximum usable size of the transfer sheet. Therefore, particularly when transfer sheets having a small size are continuously used for copying operation, and subsequently a large size of the transfer sheet is used for the copying operation, the quality of the image becomes deteriorated.

In such sequential copying operations, there exist, on the transfer drum surface during the small size copying operation, both of a portion covered by the transfer sheet and a portion not covered thereby. This produces electric property differences (potential hysteresis) in the dielectric material sheet constituting the transfer drum between the covered portion and the uncovered portion. This difference produces, in the subsequent image transfer operation on the large size transfer sheet, non-uniform transfer due to the electric property difference of the dielectric material sheet, whereby the quality of the image is degraded. The above has been found by the investigation by the present inventors.

In addition, when a transfer bias is applied or changed for the covered and uncovered portions, a potential differences are produced on the photosensitive member (image bearing member) by the presence and the absence of the transfer sheet. When the potential difference is created on the photosensitive member, the difference remains as a transfer memory, which can not be completely removed by the pre-discharge by light application or the like prior to the next image forming operation. Therefore, a non-uniform image is formed during the next image forming operation. SUMMARY OF THE INVENTION Accordingly, it is a principal object of the invention to provide an image forming apparatus wherein a plurality of transfer materials are electrostatically attracted on a transfer material carrying member, and a good quality of images can be provided with a simple structure and at a high image forming speed.

It is another object of the present invention to provide wherein the image quality deterioration attributable to the presence and absence of the transfer material on the transfer material carrying member.

As a result of their investigation, the inventors have found that the above object can be achieved by attracting the transfer material by electrostatic attraction, and by plural transfer materials are continuously attracted on the surface of the transfer material when plural transfer materials having a small size are to be continuously used, to minimize the portion where the transfer material does not exist.

These and other objects, features and advantages of the present invention will become more apparent upon a consideration of the following description of the preferred embodiments of the present invention taken in conjunction with the accompanying drawings.

In this embodiment, the photosensitive drum 1 is an OPC (organic photoconductor) photosensitive drum having a negatively charging property, which is negatively charged by the charger 2, and the portion which is to receive the toner is exposed by the exposure means, by which the potential of the portion is attenuated to provide an electrostatic contrast constituting the latent image. The latent image is reverse-developed with the negatively charged toner particles of the developing device 4.

The movable developing device 4 comprises four developing units 4M, 4C, 4Y and 4B which contain magenta developer, cyan developer, yellow developer and black developer, respectively, and guiding members (not shown) for supporting the four developing units for movement in a horizontal plane.

The movable developing device 4 transports a desired one of the developing units to a developing position where it is faced to an outer periphery of the photosensitive drum 1 to develop the electrostatic latent image on the photosensitive drum.

The transfer material P is carried by the transfer device 30 which will be described in detail hereinafter and is conveyed by the developing device 30 in the direction indicated by an arrow in the Figure, and is brought into contact to the photosensitive drum 1 and receives the toner image which has been formed on the photosensitive drum 1 as the visualized image. The transfer material P is supplied to the transfer device 30 in synchronism with the image on the photosensitive drum 1 by the registration roller 6A.

The residual toner particles remaining on the photosensitive drum 1 surface is removed by the cleaning device 30, so that the photosensitive drum 1 is prepared for the repeated color image forming process operation.

Figure 1:
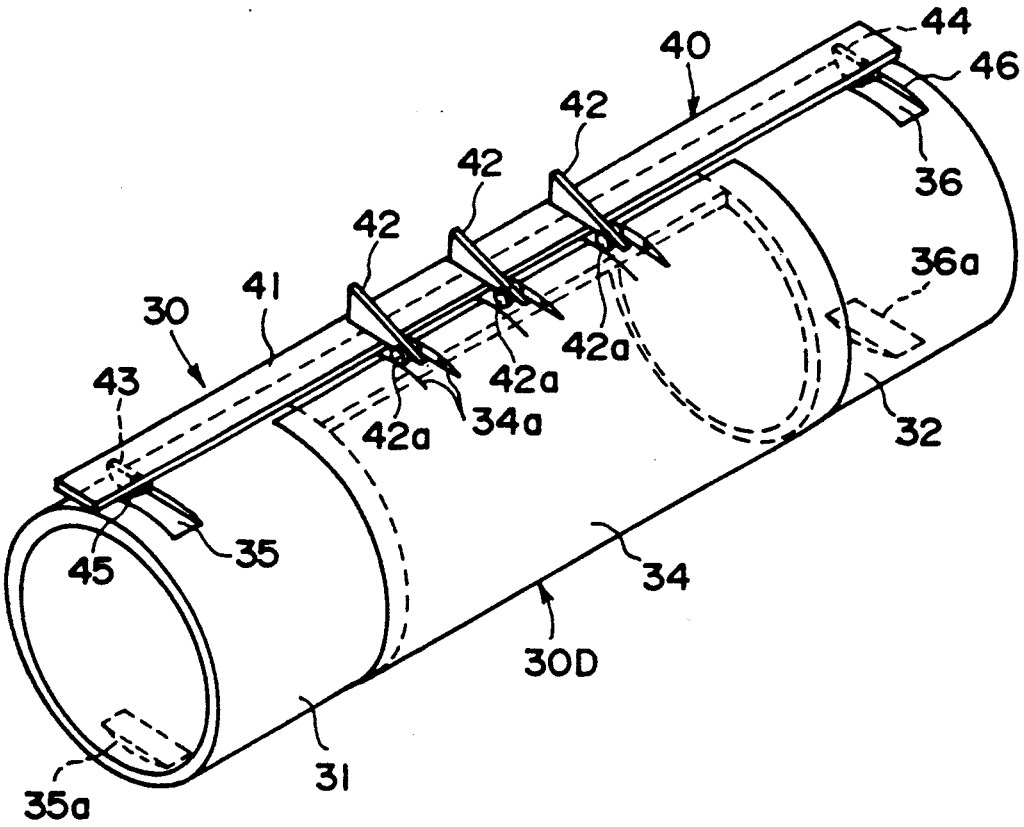
FIG. 1 is a perspective view of an image transfer device used with an image forming apparatus according to an embodiment of the present invention.
Figure 2:
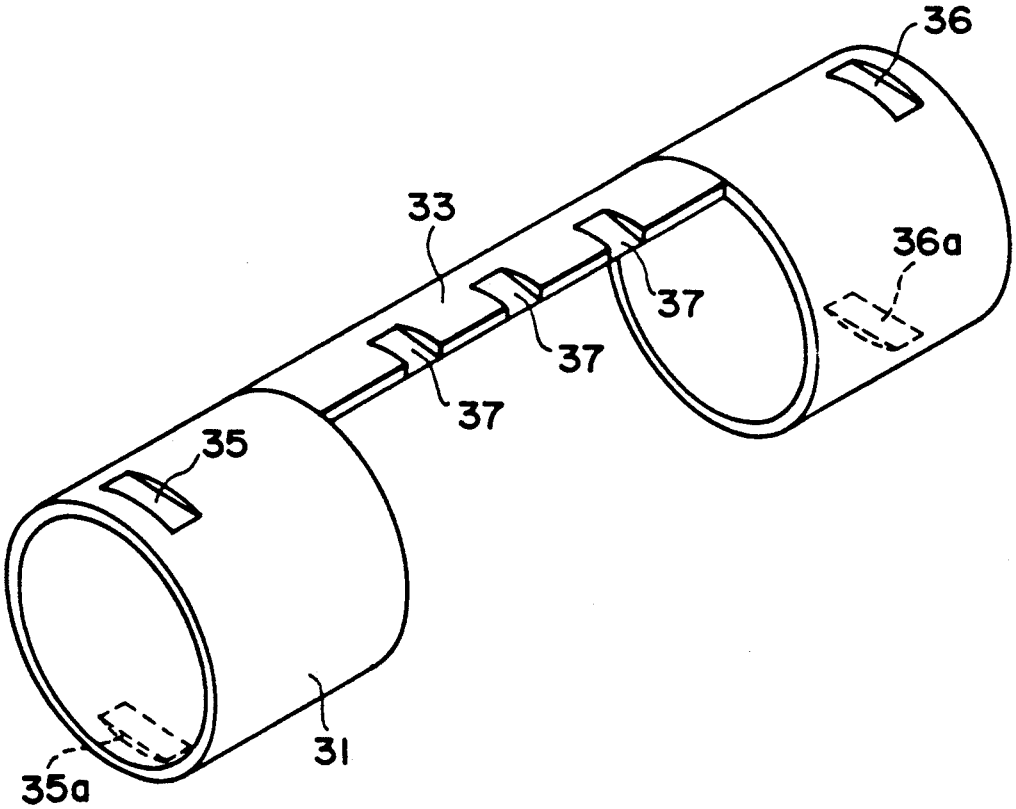
FIG. 2 is a perspective view illustrating a transfer drum frame of the transfer device of FIG. 1.

Referring now to FIGS. 1 and 2, an example of the transfer device 30 used with the color electrophotographic apparatus according to an embodiment of the present invention will be described. In this embodiment, the transfer device 30 comprises cylindrical rings 31 and 32 at opposite longitudinal ends and a connecting portion 33 for connecting the rings 31 and 32. The rings 31 and 32 and the connecting portion 33 constitute a transfer drum frame for supporting a transfer material carrying sheet 34 which is a transfer material supporting member, including dielectric material film.

Figure 3A:
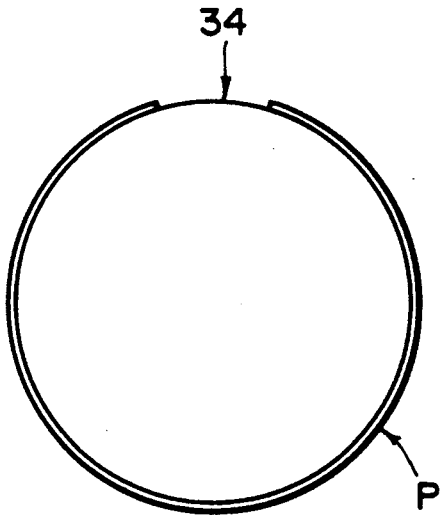
FIGS. 3A and 3B illustrate the transfer materials wrapped around the transfer drum.
Figure 3B:
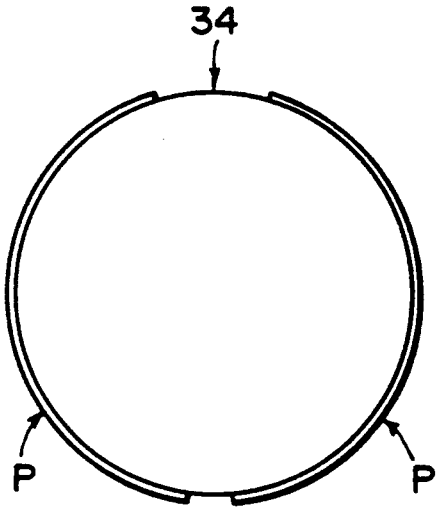

In this embodiment, the drum frame wrapped with the transfer material carrying sheet constitutes an image transfer drum 30D. The transfer drum 30D has an outer diameter of 160 mm, in this embodiment. As shown in FIGS. 3A and 3B, the circumferential length of the transfer drum 30D has a circumferential length enough to carry one A3 size sheet or one B4 size sheet with the length of the sheet being codirectional with the circumferential direction of the transfer drum, and also enough to carry two A4 size sheets or two B5 size sheets with the length of the sheets being codirectional with the longitudinal direction of the transfer drum.

In FIG. 3B, there is a space between the two transfer materials P carried on the transfer material carrying sheet 34, but this space is not indispensable i.e., the space between the transfer materials P may be removed.

In this embodiment, it is possible for the size of the transfer material used to be detected by detecting means, and also the number of sheets to be subjected to the image forming operation is detected by detecting means, and in response to those detections, a CPU can decide whether one or two transfer materials are wrapped on the transfer drum.

Figure 12:
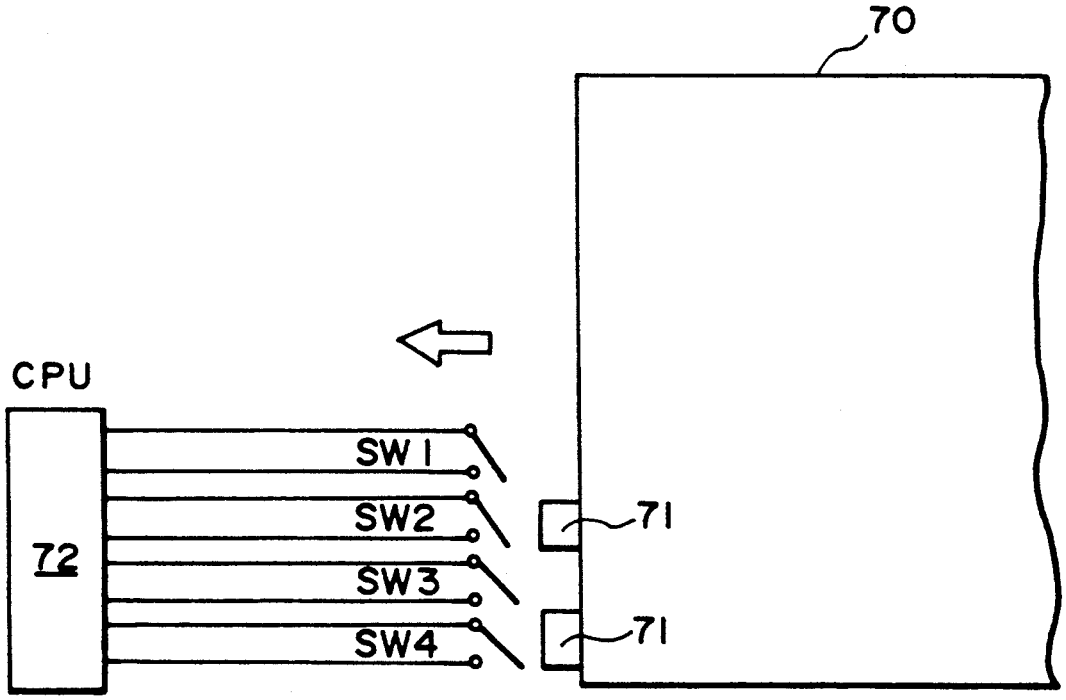
FIG. 12 is a side view of means for detecting sizes of a transfer material.

As shown in FIG. 12, the transfer material size detecting means may comprise projections 71 provided on the cassette 70 for accommodating the transfer materials and microswitches SW1-SW4 on the image forming apparatus which are selectively depressed by the projections 71 when the cassette 70 is set in the apparatus. The configuration of the projection 71 is different depending on the size of the transfer material contained in the cassette, and therefore, the microswitch or microswitches depressed by the projection 71 are different. In response to the selective actuation of the microswitch, the signal is introduced into the CPU 72, and the number of the copies to be taken is set in the CPU 72 by an unshown input button. On the basis of those settings, the CPU 72 decides how many transfer materials P are attracted on the transfer drum, and it controls the attracting operation.

In this embodiment, the transfer device 30 further includes separating means 40 which comprises a separation pawl supporting member 41 arranged along an axis of the transfer drum 30D and plural, three in this embodiment, separation pawls 42 fixed on the supporting member 41. The separating pawl 42 is provided at its end integrally with a roller 42*a* which is pressed to the outside of the transfer drum 30D to perform the function which will be described hereinafter. As will be understood from FIGS. 1-4, at the opposite ends of the supporting member 41, pressing rollers 45 and 46 are disposed through supporting plates 43 and 44. The pressing rollers 45 and 46 are contacted to the rings 31 and 32 of the transfer drum 30D when a half turn clutch 74 for operating the separation pawl operates. The rollers 45 and 46 are guided by the guiding grooves 35 and 36 formed in the rings 31 and 32 to rotate the separation pawl 42 to move its end downwardly, that is, in the direction substantially perpendicular to the surface of the transfer drum 30D.

Figure 13A:
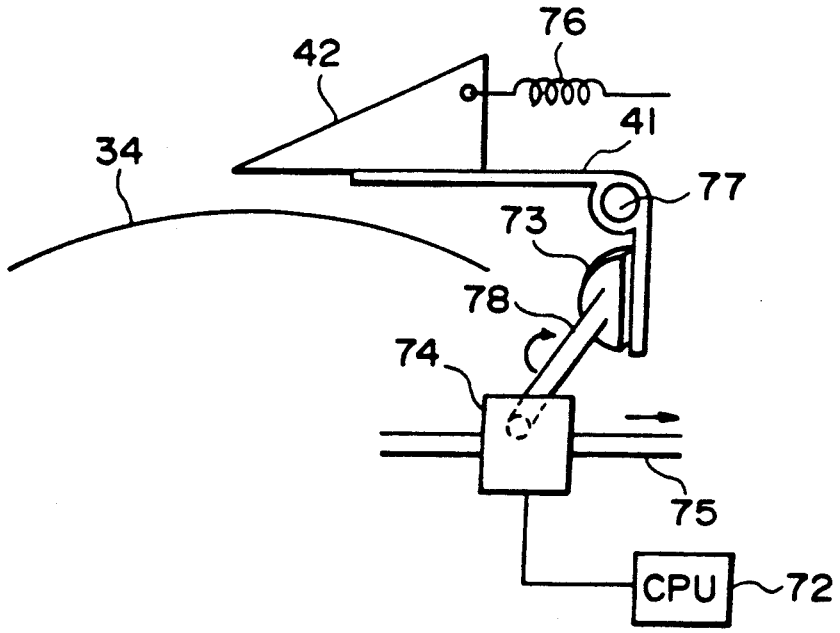
FIGS. 13A and 13B illustrate a separating operation by separating means. cl DETAILED DESCRIPTION OF THE PREFERRED EMBODIMENTS Referring to FIG. 8, there is shown a color electrophotographic apparatus as an exemplary image forming apparatus according to an embodiment of the present invention. In this embodiment, the copying machine comprises an image bearing member in the form of an electrophotographic photosensitive drum 1 supported for rotation in the direction indicated by an arrow. The photosensitive drum 1 is uniformly charged by a primary charger 2 and is exposed to light image 3 corresponding to image information by exposure means including, for example, a laser beam exposure device, so that an electrostatic latent image is formed on the photosensitive drum 1. The electrostatic latent image is visualized into a toner image on the photosensitive drum 1 by a movable developing device 4.
Figure 13B:
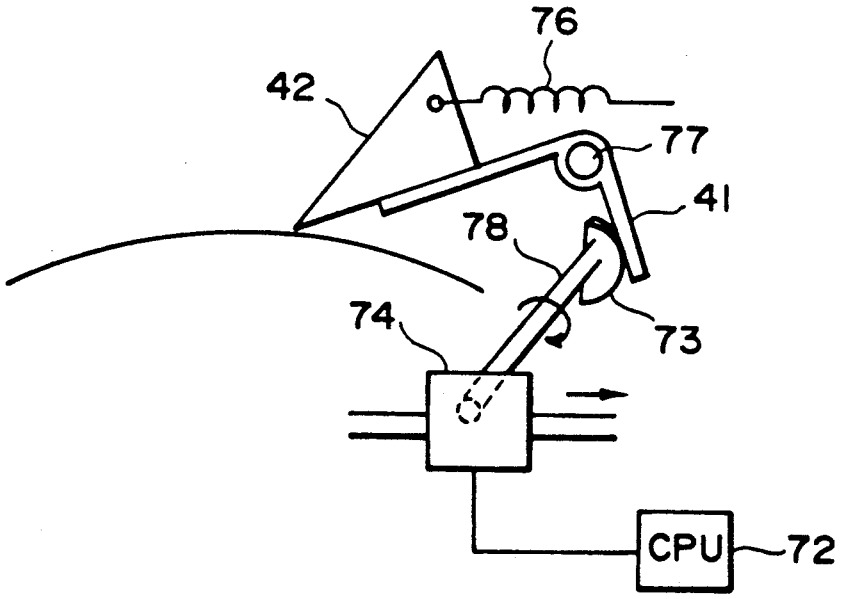

Referring to FIGS. 13A and 13B, the description will be made as to the operation of the separation pawl 42. As shown in FIG. 13A, the separation pawl 42 is urged rightwardly by a spring 76, but is normally maintained at its non-operative position wherein it does not perform the separating operation. The supporting member 41 for supporting the separation pawl 42 is rotatable about a shaft 77. The supporting member 41 is driven by an actuating plate 73 having a generally part-circular e.g., (half-circular) disk supported on an output shaft 78 of a half turn clutch 74 controlled by the CPU 72. When the half turn clutch 74 takes its engaging position, the driving force is transmitted to the output shaft 78 through driving means 75 in the form of a belt or chain. When the separating pawl 42 performs its separating action, a signal is produced from the CPU 72, and the shaft 78 is rotated through one half turn by the half turn clutch 74 taking its engaging position, from the state shown in FIG. 13A. Therefore, the actuating plate 73 rotates the supporting member 41 about the shaft 77 in the counterclockwise direction to move the separating pawl 42 to its operating position wherein it performs the separating function, as shown in FIG. 13B. After the separating operation, the shaft 78 rotates through one half turn by the half turn clutch 74, and the restoring force of the spring 76 rotates the supporting member 41 and the separating pawls 42 in the clockwise direction to return them to the non-operative position shown in FIG. 13A.

Although not shown in FIGS. 13A and 13B, the rollers 42*a*, 45 and 46 and the separating plates 43 and 44 make the same motion as the separating pawls 42 and the supporting member 41.

Figure 5:
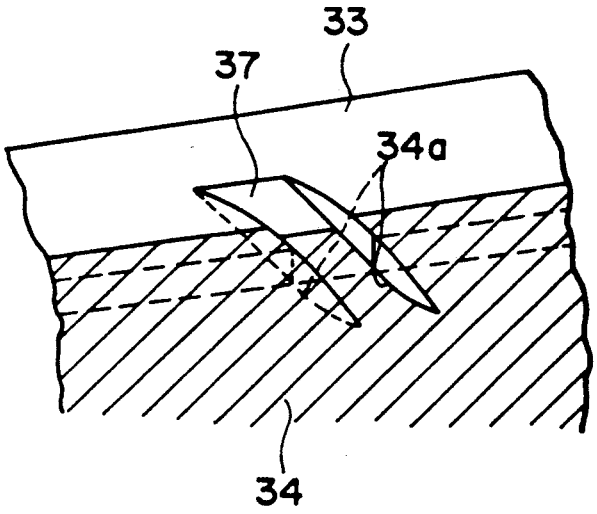
FIG. 5 is a perspective view illustrating a relationship between a connecting portion and the transfer sheet in the transfer device of FIG. 1.

The connecting portion 33 is provided with cut-away portions 37 to assist or facilitate insertion of the separating pawls 42 between the transfer material carrying sheet 34 and the transfer material P attracted and carried on the transfer material carrying sheet 34. As shown in FIGS. 1 and 5, the edge of the transfer material carrying sheet 34 is provided with cuts 34*a* along the cut-away portions 37 of the connecting portion 33 within a non-image-forming region of the transfer material in which the toner image is not transferred onto the transfer material. Therefore, the transfer material carrying sheet 34 indicated by hatching line in FIG. 5 is bonded to the connecting portion 33 so as to provide local large curvature portions.

Figure 8:
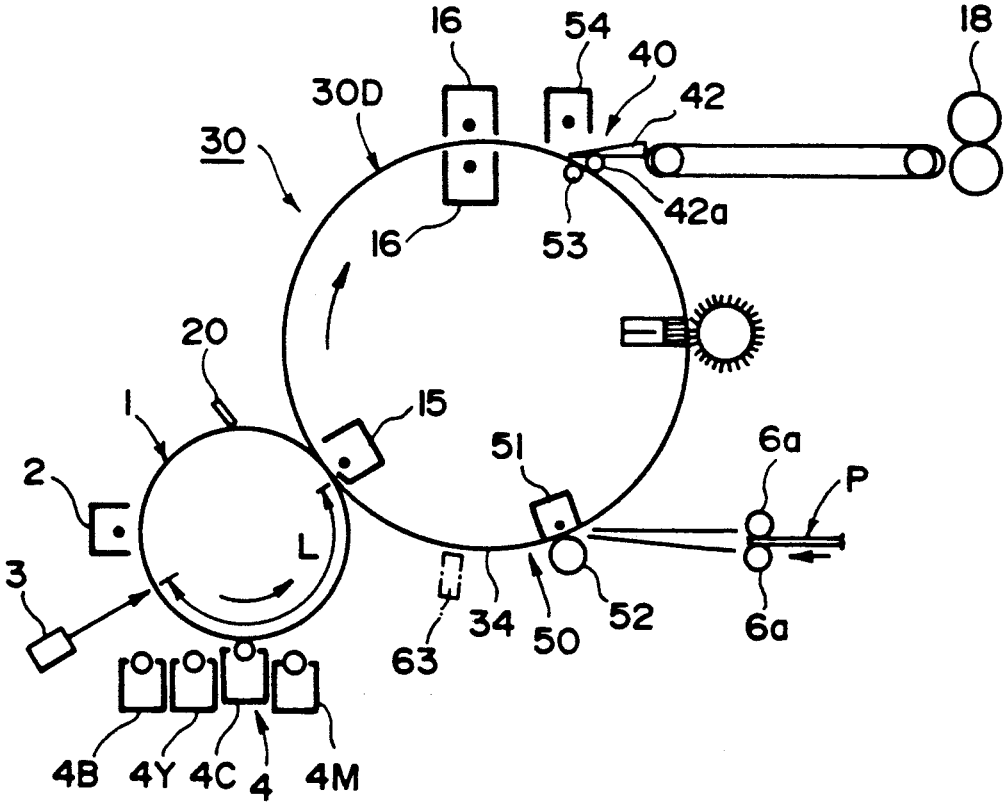
FIG. 8 is a sectional view of an image forming apparatus according to the embodiment of the present invention shown in FIG. 1.

The transfer device 30 includes transfer material attracting means 50 for attracting and retaining on the transfer material carrying sheet 34 the transfer material P supplied to the transfer device. As shown in FIG. 8, the transfer material attracting means 50 includes an attracting corona charger 51 which is disposed within the transfer drum 30 and which applies to the back side of the transfer material carrying sheet electric charge having the polarity opposite to that of the toner image on the photosensitive drum 1, that is, the positive charge in this embodiment, and a conductive roller 52 disposed outside of the transfer drum 30D. The conductive roller 52 is grounded and functions as an opposite electrode of the attracting corona charger 31 to inject the electric charge into the transfer material P and to electrostatically attract the transfer material P to the transfer material carrying sheet 34.

Preferably, the transfer material P is supplied such that the non-image-forming region at its leading edge is overlapped with the cuts 34*a* of the transfer material carrying sheet 34 and is not overlapped with the image forming region. As for the continuous image formation, when the length of the transfer material measured along the direction of the transfer material transportation is less than a half of the circumferential length of the transfer drum capable of supporting the transfer material, two transfer materials are retained on the transfer material. More particularly, when the length of the sheet used is less than one half the length which is the circumferential length of the transfer drum subtracted by the width of the connecting portion, the second transfer material is supplied subsequently to the first sheet, so that the second transfer material is attracted on the transfer material carrying sheet 34 in the position diametrically opposite to the first transfer sheet, as shown in FIG. 3B. Thus, two transfer materials P are simultaneously retained on the transfer material carrying sheet.

The transfer material P attracted by the transfer device 30 is conveyed to the image transferring operation position where the transfer charger 15 is disposed. In the transferring position, the image transfer corona charger 15 applies to the back side of the transfer material carrying sheet 34 the electric charge having the polarity opposite to that of the toner, thus transferring onto the first transfer material P the toner image formed with the first color developer, the magenta toner, for example. Subsequently, the same latent image is formed on the photosensitive drum, which is developed with the same, that is, the first color toner, which is in turn transferred onto the second transfer material P retained on the transfer material carrying sheet 34. Prior to the first transfer material reaching for the second time to the conductive roller 52, the conductive roller 52 is released so that it is moved away from the transfer material carrying sheet 34, through, for example, not less than 2 mm, to a position where it does not disturb the toner image transferred onto the transfer material P.

A second toner image is formed on the photosensitive drum in synchronism with the first transfer material having received the first color image and is transferred onto the first transfer material P by the transfer corona charger 15. Similarly, the second transfer material having received the first color toner image receives the second color toner image. In a similar manner, the two transfer materials P receive four color toner images, respectively.

The transfer device 30 is provided with a pair of AC corona dischargers 16 at opposite sides of the transfer material carrying sheet 34 so as to weaken the attracting force between the transfer material and the transfer material carrying sheet after completion of the image transferring operation. It is effective to electrically discharge the transfer material P and the transfer material carrying sheet 34.

In order to separate the first transfer material P from the transfer material carrying sheet 34, the pressing rollers 45 and 46 are moved together with the supporting member 41 for the separating means 40 by the half turn clutch 74 for actuating the separating pawls, as will be understood from FIGS. 1, 4, 13A and 13B, so that they are contact to the rings 31 and 32 of the transfer drum 30D. They are guided by the guiding grooves 35 and 36 of the rings 31 and 32. By this, the edges of the separating pawls 42 are rotated downwardly, that is, in the direction perpendicular to the transfer drum 30D surface toward the transfer material carrying sheet 34, whereby the pressing roller 42*a* moved integrally with the separating pawl supporting member 41 is pressed to the transfer material carrying sheet 34. The pressing roller 42*a* moves along the cut-away portion 37 of the connecting portion 33, and the separating pawl 42 wedges between the edge of the first transfer material and the transfer material carrying sheet 34 at the position where the curvature of the transfer material carrying sheet 34 is locally large, so that the transfer material P is separated from the transfer material carrying sheet 34. In this manner, the leading edge of the transfer material is separated from the transfer material carrying sheet 34 by deformation of the transfer material carrying sheet 34, and therefore, the separating pawls do not directly damage the transfer material carrying sheet 34, so that good transferring operation is assured. At this time, the inside separation roller 53 which is to be pressed to the inside of the transfer material carrying sheet is not driven.

Figure 4:
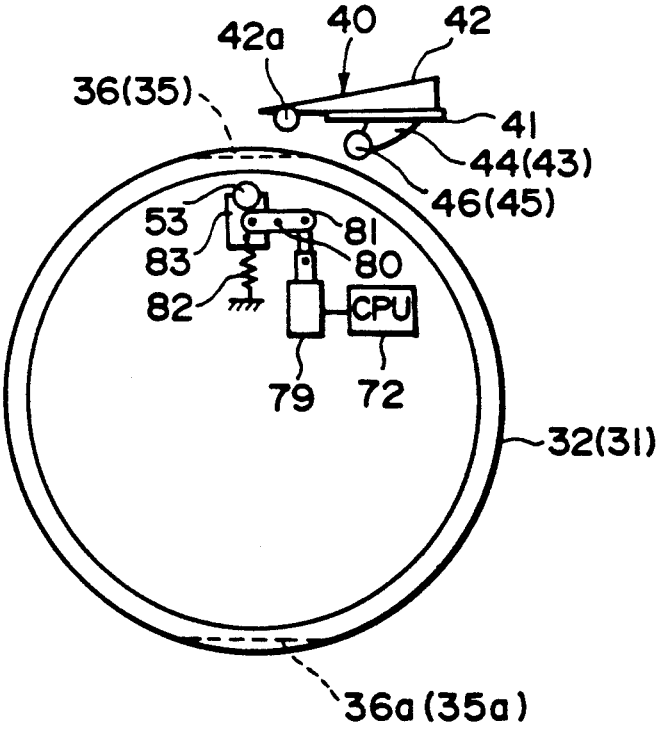
FIG. 4 is a side view illustrating transfer material separating means used with the transfer device of FIG. 1.
Figure 6:
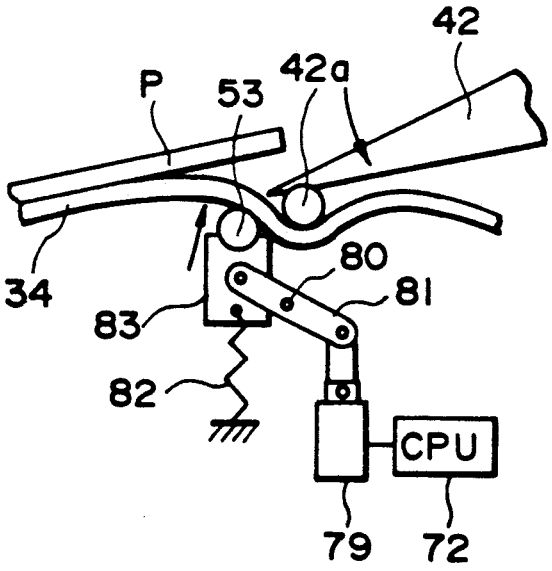
FIG. 6 illustrates a separating operation by the separating means.

Referring back to FIGS. 4 and 6, when the second transfer material P is to be separated from the transfer material carrying sheet 34, the inside separating roller 53 disposed within the transfer drum 30D is pressed to the inside of the transfer material carrying sheet 34 by energization of the solenoid 79 controlled by the CPU 72. As shown in FIG. 4, the solenoid 79 is coupled by a coupling member 81 to the supporting member 83 for supporting the inside separating roll 53. The coupling member 81 is rotatable about a shaft 80 and is rotatably joined with the supporting member 83 and with the solenoid 79. The supporting member 83 is urged downwardly by the spring 82. Therefore, as described hereinbefore, when the solenoid 79 is energized in the state shown in FIG. 4, the coupling member 81 rotates clockwisely about the shaft 80 to raise the roller 53 supported on the supporting member 83 to provide the state shown in FIG. 6. When the solenoid 79 is deenergized, the state of FIG. 4 is restored.

The outside separating pawl 42*a* is also pressed to the outside of the transfer material carrying sheet 34 by the pressing rollers 45 and 46 of the separating means 40 being guided along the grooves 35*a* and 36*a* formed at the opposite side of the connecting portion 33 for connecting the rings 31 and 32. As will be understood, the curvature of the transfer material carrying sheet is locally changed by the roller 42*a*, so that the edge of the transfer material is separated by the curvature change, and the separation is completed by inserting the separating pawl 42 between the transfer material P and the transfer material carrying sheet 34. In this embodiment when the transfer material carrying sheet is deformed, both of the outside separating roller 42*a* and the inside separating roller 53 are operated, but only one of them is actuated to deform the sheet.

It is preferable that a corona discharger 54 is used to perform an AC corona discharging operation so as to prevent disturbance to the image due to separation discharge which is produced when the transfer material P and the transfer material carrying sheet 34 are separated.

When the length of the transfer material measured in the transfer material conveying direction is longer than the above-described (FIG. 3A), the leading edge of the transfer material P is attracted on the transfer material carrying sheet 34 at the same position as the first transfer material described above, and the image transferring and the transfer sheet separating operations are performed in the same manner as the first transfer material described hereinbefore. At this time, the inside separating pawl 53 is not driven.

After the image transferring and the transfer material separating operations are completed, the transfer material P is conveyed to the fixing device 18, where the toners are mixed and fixed by application of heat thereto. Then, the transfer material is discharged so that the image forming operation is completed.

Figure 7:
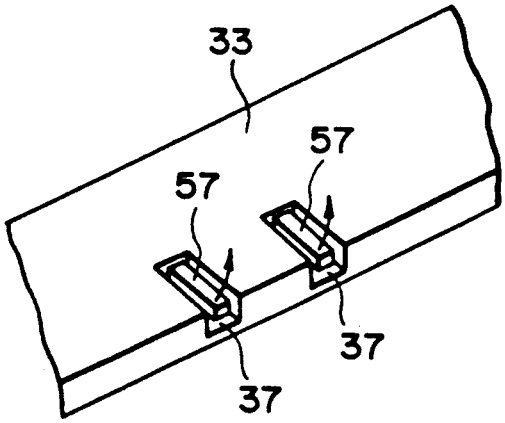
FIG. 7 is a perspective view illustrating another example of the connecting portion of the transfer device of FIG. 1.

FIG. 7 illustrates a transfer device 30 according to another embodiment of the present invention. In this embodiment, a raising member 57 for raising the leading edge of the first transfer material toward outside of the transfer material to separate it, is additionally provided in the cut-away portion 37 formed in the connecting portion 33 of the transfer drum frame. The first transfer material P is supplied in such a manner that it is attracted with its non-image-forming region (adjacent its leading edge) above the raising member 57. After the four color toner images are transferred from the photosensitive drum 1 onto the transfer material P supported on the transfer material carrying sheet 34, the raising member 57 is driven in the direction of an arrow at the position of the separating pawl 42 so as to separate the leading edge of the transfer material from the transfer material carrying sheet and so as to introduce the separating pawls 42 between the transfer material P and the transfer material carrying sheet 34, thus effecting the transfer material separating function. The separation of the second transfer material when two transfer materials are attracted on the transfer material carrying sheet 34, is the same as described with FIGS. 4 and 6, that is, by deformation of the transfer material carrying sheet 34.

Figure 9:
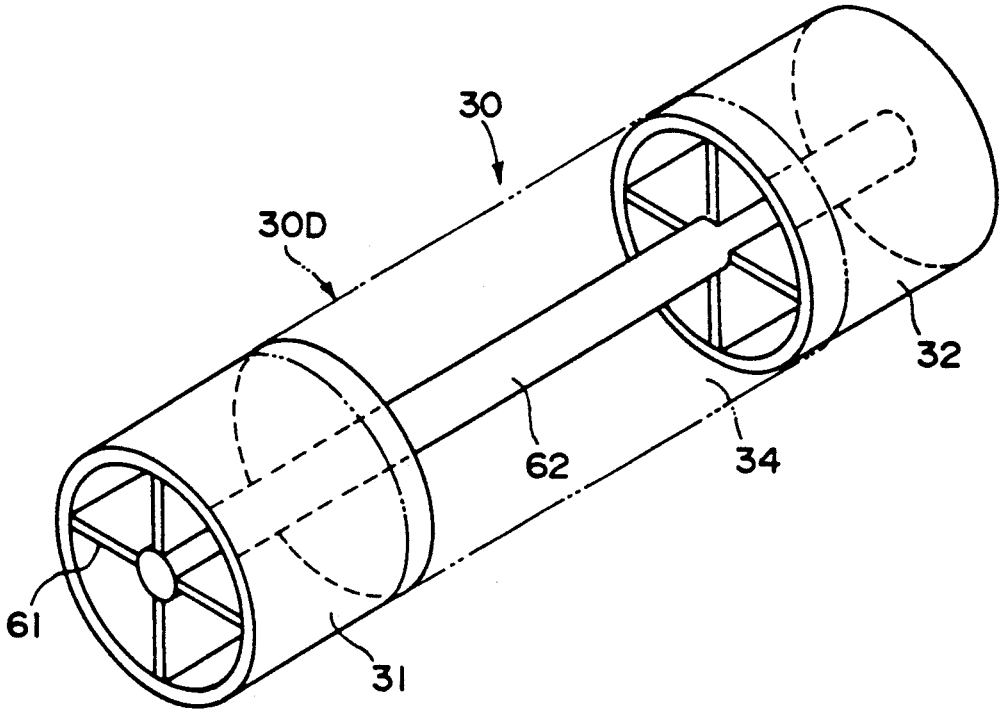
FIG. 9 is a perspective view of another example of the transfer device according to an embodiment of the present invention.
Figure 10:
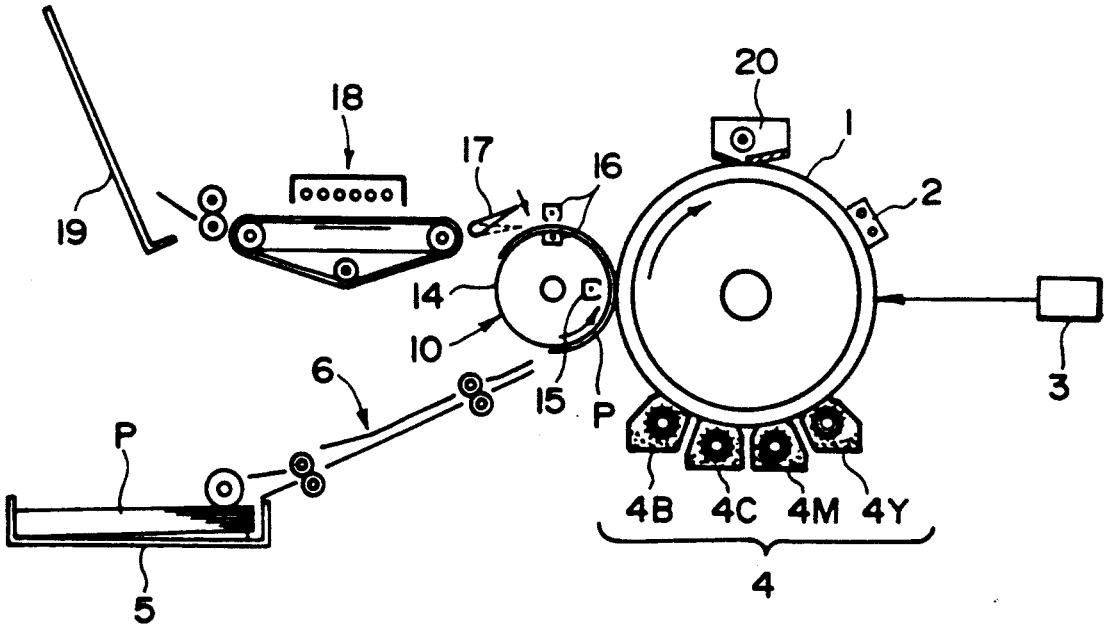
FIG. 10 is a sectional view of a conventional electrophotographic copying apparatus.
Figure 11:
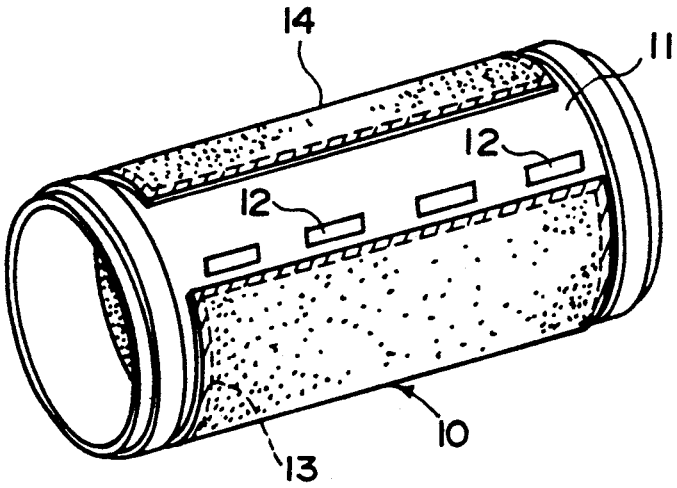
FIG. 11 is a perspective view of an example of a conventional transfer device.

Referring to FIG. 9, there is shown a further embodiment of the transfer device 30. In the foregoing embodiments, as will be understood from FIG. 2, the transfer drum frame is constituted by rings 31 and 32 and connecting portion 33 therebetween, and the transfer material carrying sheet 34 is wrapped around the frame, and therefore, the transfer material attracting position on the transfer material carrying sheet 34 is determined. In the present embodiment, the transfer drum D is constituted by rings 31 and 32 which are fixed to a central supporting shaft 62 by proper supporting members 61 to constitute a transfer drum frame. On the frame, a seamless transfer material carrying sheet 34 is wrapped.

In this embodiment, the transfer material carrying sheet 34 is in the form of a seamless cylinder, and therefore, the transfer material can be supported thereon at any position. The transfer material P can be supplied without strict control relative to the rotational position of the transfer drum. The transfer material P is attracted on the transfer material carrying sheet 34 by the attracting corona charger 51 and the conductive roller 52.

As shown in FIG. 8, when such a transfer device 30 is used, a transfer material detecting sensor 63 is disposed downstream of the attracting means 50 to detect the position of the transfer material. The transfer material detecting sensor 63 is disposed upstream of the transfer position by a distance on the circumference of the transfer drum 30, which is longer than a distance L from the image exposure position to the image transfer position measured along the circumference of the photosensitive drum 1. As for the continuous copying operation, when the length of the transfer material measured along its conveyance, is less than one half of the circumferential length of the transfer drum, the second transfer material is supplied sequentially. It is detected by the transfer material detecting sensor 63, and thereafter, the latent image is formed on the photosensitive drum 1 in synchronism with the detected transfer material, and the image is developed and transferred onto the transfer material.

In this embodiment, the four color toner images on the photosensitive drum 1 are sequentially transferred, the first and second transfer materials P on the transfer drum are separated. During the separating operation, the inside separating roller 53 and the outside separating roller 42*a* movable together with the separating pawls 42 are pressed to the transfer material carrying sheet 34 to locally reduce the curvature of the transfer material carrying sheet 34, thus separating the leading edge of the transfer material by the curvature, and the separating is completed by inserting the separating pawls 42 between the transfer material and the transfer sheet.

The above embodiments are directed to a color electrophotographic apparatus, but the present invention is not limited to such an apparatus and is usable with another image forming operation, for example, a monochromatic color image forming apparatus if it is provided with a transfer device which is not limited to a superposed image transfer device. The configuration of the transfer device is not limited to a cylindrical, but it may be in the form of a belt, for example.

In the foregoing embodiment, the photosensitive drum as the image bearing member is made of an OPC photosensitive member having a negative charging polarity, and a reverse-development is effected, and therefore, the polarity of the charging voltage for formation of the latent image is negative, and the transfer voltage is positive. Accordingly, the state of electric charge on the photosensitive member is different between the position where the transfer material is present and the position where it is absent, by the charging effect of the transfer means. More particularly, the transfer means applies positive charge to the photosensitive member where the transfer material is absent. Particularly when the photosensitive member used has a negative charging property, the positive memory can remain even to such an extent that the discharging operation such as the uniform light exposure after the transfer can not completely dissipate the positive charge. Here, it is added that the negative charge is easily removed when such an OPC photosensitive member is used. The potential difference of the photosensitive member due to the presence and absence of the transfer material results in non-uniform image density in the next image formation.

In the reversal-development, therefore, it is particularly effective to support plural transfer materials on the transfer material carrying means because less electric charge is applied to the image bearing member by the transfer means. However, the present invention is applicable also to a regular development.

As described in the foregoing, according to the present invention, plural transfer materials are electrostatically attracted and supported on the transfer material carrying means, and therefore, good image quality can be provided at a high overall image formation speed with a simple structure.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for forming an image on said image bearing member;

transfer means for electrostatically transferring the image from said image bearing member to a transfer material;

transfer material carrying means for carrying the transfer material to an image transfer position where the image is transferred from said image bearing member onto the transfer material said transfer material carrying means being repeatedly movable to the image transfer position; and transfer material attracting means for electrostatically attracting the transfer material onto the transfer material carrying means, said transfer material carrying means being capable of attracting and supporting a plurality of the transfer materials simultaneously thereon at different positions thereon, wherein the plural transfer materials carried on said transfer material carrying means are presented plural times to the image transfer position to be subjected to plural image transfer operations by said transfer means, wherein one of the transfer materials is subjected to the transfer operation at a time.

2. An apparatus according to claim 1, further comprising separating means for separating the transfer material from said transfer material carrying means.

3. An apparatus according to claim 2, wherein said separating means is movable between an operative position for separating the transfer material from the transfer material carrying means and a non-operative position away from said transfer material carrying means where it does not separate the transfer material.

4. An apparatus according to claim 3, further comprising driving means for driving said separating means between the operative position and the inoperative position.

5. An apparatus according to claim 3, wherein said separating means including a separating member insertable between said transfer material carrying means and the transfer material for its separating operation.

6. An apparatus according to claim 5, wherein said separating member is a separating pawl.

7. An apparatus according to claim 4, wherein said separating means including deforming means for deforming said transfer material carrying means for its separating operation.

8. An apparatus according to claim 5, wherein said separating means including deforming means for deforming said transfer material carrying means for its separating operation.

9. An apparatus according to claim 7, wherein said transfer material carrying means includes a sheet member, which is deformed by said deforming means to separate the transfer material from the transfer material carrying means.

10. An apparatus according to claim 7 or 8, wherein said deforming means includes a pressing member for pressing to said transfer material carrying means at its side opposite from a surface thereof for carrying the transfer material.

11. An apparatus according to claim 7, wherein said deforming means includes a pressing member for pressing to said transfer material carrying means at its side for carrying the transfer material.

12. An apparatus according to claim 8, wherein said deforming means includes a pressing member for pressing to said transfer material carrying means at its side for carrying the transfer material.

13. An apparatus according to claim 10, wherein said deforming means includes a pressing member for pressing to said transfer material carrying means at its side for carrying the transfer material.

14. An apparatus according to claim 12, wherein the pressing member is integral with the separating member.

15. An apparatus according to claim 1, wherein said transfer material carrying means is in the form of a drum and includes ring portions at opposite longitudinal ends and a connecting portion connecting the ring portions, and wherein a sheet member covers an opening defined by said ring portions and said connecting portion.

16. An apparatus according to claim 1, wherein said transfer material carrying means is rotated plural times to transfer plural images onto the same transfer material carried on said transfer material carrying means by said transferring means, thus providing a superposed image.

17. An apparatus according to claim 16, wherein the superposed image is formed by different color toners.

18. An apparatus according to claim 2, wherein said separating means performs different operations depending on the positions where a leading edge of the transfer material is attracted on the transfer material carrying means by said transfer material attracting means.

19. An apparatus according to claim 18, wherein said separating means is movable between an operative position for separating the transfer material from the transfer material carrying means and an inoperative position away from said transfer material carrying means where it does not separate the transfer material 20. An apparatus according to claim 19, further comprising driving means for driving said separating means between the operative position and the inoperative position.

21. An apparatus according to claim 19, wherein said separating means includes deforming means for deforming said transfer material carrying means for its separating operation.

22. An apparatus according to claim 21, wherein said deforming means includes a pressing member for pressing to said transfer material carrying means at its side opposite from a surface thereof for carrying the transfer material.

23. An apparatus according to claim 3, 5 or 19, wherein said separating means includes a raising member for raising the transfer material from said transfer material carrying means.

24. An apparatus according to claim 1, wherein said transfer material attracting means includes a grounded roller for pressing the transfer material to the transfer material carrying means and a corona discharger, disposed across said transfer material carrying means from said roller, and supplied with a voltage opposite to that of the image to be transferred to the transfer material.

25. An apparatus according to claim 1, wherein said image forming means includes latent image forming means for forming a latent image on said image bearing member and developing means for developing the latent image, wherein said latent image forming means includes charging means for charging said image bearing member.

26. An apparatus according to claim 25, wherein said developing means develops the latent image on said image bearing member with toner having a polarity the same as a charging polarity of said charging means.

27. An apparatus according to claim 1, wherein said transfer material carrying means includes a seamless sheet member.

28. An apparatus according to claim 1, wherein said transfer material carrying means holds the transfer material only by electrostatic force.

29. An apparatus according to claim 25 or 26, wherein said charging means has a charging polarity which is the same as that of said transfer means.

30. An apparatus according to claim 29, wherein said image bearing member is of an organic photoconductor.

31. An apparatus according to claim 1, wherein said transfer material carrying means includes a dielectric sheet for holding the transfer material.

32. An image forming apparatus comprising:

a movable image bearing member;

means for forming an image on said image bearing member;

transfer means for transferring the image from said image bearing member to a transfer material;

transfer material carrying means for carrying the transfer material to an image transfer position where the image is transferred from said image bearing member onto the transfer material, said transfer material carrying means accessible to only one image transfer position;

transfer material attracting means for electrostatically attracting the transfer material onto the transfer material carrying means, said transfer material carrying means being capable of attracting a plurality of the transfer materials onto the transfer material carrying means at different positions, wherein said transfer material carrying means includes a seamless sheet member; and transfer material detecting means, disposed downstream of said transfer material attracting means with respect to movement direction of said transfer material carrying means, for detecting the transfer material attracted on the transfer material carrying means.

33. An apparatus according to claim 32, wherein said image forming means is operated in accordance with detection of the transfer material by said transfer material detecting means.

34. An apparatus according to claim 32 or 33, wherein said image bearing member includes a photosensitive member, and said image forming means includes image exposure means for exposing the photosensitive member to imagewise light, and wherein a distance of movement of the transfer material from a point of detection by said detecting means to the image transfer position is not less than a distance, measured along a surface of said image bearing member, from the image exposure means to the image transfer position.

35. An image forming apparatus, comprising:

a movable image bearing member;

means for forming an image on said image bearing member;

transfer means for transferring the image from said image bearing member to a transfer material;

transfer material carrying means for carrying the transfer material to an image transfer position where the image is transferred from said image bearing member onto the transfer material; and transfer material attracting means for electrostatically attracting the transfer material onto the transfer material carrying means, said transfer material attracting means being capable of attracting a different number of the transfer materials on said transfer material carrying means, wherein the number of the transfer materials carried on said transfer material carrying means is different depending on a size of the transfer material.

36. An apparatus according to claim 35, wherein said transfer material carrying means includes a transfer material carrying portion for carrying the transfer material, and carries a plurality of transfer materials on said transfer material carrying portion when the transfer material has a length smaller than one half of the transfer material supporting portion.

37. An apparatus according to claim 35, further comprising means for detecting a size of the transfer material.

38. An apparatus according to claim 35 or 36, wherein the number of the transfer materials carried on the transfer material carrying means is determined in accordance with a number of images to be formed on said image bearing member.

39. An apparatus according to claim 35, further comprising separating means for separating the transfer material from said transfer material carrying means.

40. An apparatus according to claim 39, wherein said separating means is movable between an operative position for separating the transfer material from the transfer material carrying means and a non-operative position away from said transfer material carrying means where it does not separate the transfer material 41. An apparatus according to claim 40, further comprising driving means for driving said separating means between the operative position and the inoperative position.

42. An apparatus according to claim 40, wherein said separating means includes a separating member insertable between said transfer material carrying means and the transfer material for its separating operation.

43. An apparatus according to claim 42, wherein said separating member comprises a separating pawl.

44. An apparatus according to claim 40, wherein said separating means includes deforming means for deforming said transfer material carrying means for its separating operation.

45. An apparatus according to claim 42, wherein said separating means includes deforming means for deforming said transfer material carrying means for its separating operation.

46. An apparatus according to claim 44, wherein said transfer material carrying means includes a sheet member, which is deformed by said deforming means to separate the transfer material from the transfer material carrying means.

47. An apparatus according to claim 44 or 45, wherein said deforming means includes a pressing member for pressing to said transfer material carrying means at its side opposite from a surface thereof for carrying the transfer material.

48. An apparatus according to claim 44, wherein said deforming means includes a pressing member for pressing to said transfer material carrying means at its side for carrying the transfer material.

49. An apparatus according to claim 45, wherein said deforming means includes a pressing member for pressing to said transfer material carrying means at its side for carrying the transfer material 50. An apparatus according to claim 47, wherein said deforming means includes a pressing member for pressing to said transfer material carrying means at its side for carrying the transfer material.

51. An apparatus according to claim 49, wherein the pressing member is integral with the separating member.

52. An apparatus according to claim 35, wherein said transfer material carrying means is in the form of a drum and includes ring portions at opposite longitudinal ends and a connecting portion connecting the ring portions, and wherein a sheet member covers an opening defined by said ring portions and said connecting portion.

53. An apparatus according to claim 32 or 35, wherein said transfer material carrying means is rotated plural times to transfer plural images onto the same transfer material carried on said transfer material carrying means by said transferring means, thus providing a superposed image.

54. An apparatus according to claim 53 wherein the superposed image is formed by different color toners.

55. An apparatus according to claim 39, wherein said separating means performs different operations depending on the positions where a leading edge of the transfer material is attracted on the transfer material carrying means by said transfer material attracting means.

56. An apparatus according to claim 55, wherein said separating means is movable between an operative position for separating the transfer material from the transfer material carrying means and an inoperative position away from said transfer material carrying means where it does not separate the transfer material 57. An apparatus according to claim 56, further comprising driving means for driving said separating means between the operative position and the inoperative position.

58. An apparatus according to claim 56, wherein said separating means including deforming means for deforming said transfer material carrying means for its separating operation.

59. An apparatus according to claim 58, wherein said deforming means includes a pressing member for pressing to said transfer material carrying means at its side opposite from a surface thereof for carrying the transfer material.

60. An apparatus according to claim 40, 42 or 56, wherein said separating means includes a raising member for raising the transfer material from said transfer material carrying means.

61. An apparatus according to claim 32 or 35, wherein said transfer material attracting means includes a grounded roller for pressing the transfer material to the transfer material carrying means and a corona discharger, disposed across said transfer material carrying means from said roller, and supplied with a voltage opposite to that of the image to be transferred to the transfer material.

62. An apparatus according to claim 28 or 35, wherein said image forming means includes latent image forming means for forming a latent image on said image bearing member and developing means for developing the latent image, wherein said latent image forming means includes charging means for charging said image bearing member.

63. An apparatus according to claim 62, wherein said developing means develops the latent image on said image bearing member with toner having a polarity the same as a charging polarity of said charging means.

64. An apparatus according to claim 35, wherein said transfer material carrying means includes a seamless sheet member.

65. An apparatus according to claim 64, further comprising transfer material detecting means, disposed downstream of said transfer material attracting means with respect to movement direction of said transfer material carrying means, for detecting the transfer material attracted on the transfer material carrying means.

66. An apparatus according to claim 32 or 35, wherein said transfer material carrying means holds the transfer material only by electrostatic force.

67. An apparatus according to claim 35, wherein said transfer means electrostatically transfers the image from said image bearing member to the transfer material.

68. An apparatus according to claim 62, wherein said transfer means electrostatically transfers the image from said image bearing member to the transfer material, and wherein said charging means has a charging polarity which is the same as that of said transfer means.

69. An apparatus according to claim 68, wherein said image bearing member is of organic photoconductor.

70. An apparatus according to claim 32 or 35, wherein said transfer material carrying means includes a dielectric sheet for holding the transfer material.

71. An apparatus according to claim 35, wherein orientation of the transfer material carried on said transfer material is different depending on an output of said detecting means.

72. An apparatus according to claim 35, wherein said transfer material carrying means is accessible to only one image transfer position where an image is transferred from the image bearing member to the transfer material carried on said transfer material carrying member.

73. An apparatus according to claim 35, wherein said transfer material carrying means is repeatedly movable to the image transfer position, wherein the plural transfer materials carried on said transfer material carrying means are presented plural times to the image transfer position to be subjected to plural image transfer operations by said transfer means, wherein one of the transfer materials is subjected to the transfer operation at a time.

74. An apparatus according to claims 1, 28 or 35, wherein said attracting means first carries the transfer material on said transfer material carrying means.

* * * * *

UNITED STATES PATENT AND TRADEMARK OFFICE

CERTIFICATE OF CORRECTION

PATENT NO. : 5,086,318

DATED : February 4, 1992

INVENTOR(S) : TAKEDA, ET AL.

It is certified that error appears in the above-identified patent and that said Letters Patent is hereby corrected as shown below:

COLUMN 3

Line 30, "of" should be deleted.
Line 42, "a" should be deleted.
Line 51, "operation. SUMMARY" should read --operation. ¶ SUMMARY--.
Line 64, "by" should be deleted.

COLUMN 4

Line 42, "means. cl DETAILED DESCRIPTION" should read --means. ¶ DETAILED DESCRIPTION--.

COLUMN 6

Line 38, "e.g.,(" should read --(e.g.,--.

COLUMN 11

Line 36, "material" should read --material,--.

UNITED STATES PATENT AND TRADEMARK OFFICE

CERTIFICATE OF CORRECTION

PATENT NO. : 5,086,318

DATED : February 4, 1992

INVENTOR(S) : TAKEDA, ET AL.

It is certified that error appears in the above-identified patent and that said Letters Patent is hereby corrected as shown below:

COLUMN 12

Line 60, "material" should read --material.--.

COLUMN 14

Line 58, "material" should read --material.--.

COLUMN 15

Line 25, "material" should read --material.--.
Line 45, "claim 53" should read --claim 53,--.
Line 57, "material" should read --material.--.

COLUMN 16

Line 14, "claim 28" should read --claim 32--.
Line 65, "28" should read --32--.

Signed and Sealed this

Twenty-second Day of June, 1993

Attest:

Michael K. Kirk

MICHAEL K. KIRK

Attesting Officer

Acting Commissioner of Patents and Trademarks